US005566528A

United States Patent [19]

Lee

[11] Patent Number: 5,566,528

[45] Date of Patent: Oct. 22, 1996

[54] FACSIMILE PACKAGING DEVICE AND METHOD

[76] Inventor: Peter H. Y. Lee, 1447 Second St., Manhattan Beach, Calif. 90266

[21] Appl. No.: 340,581

[22] Filed: Nov. 16, 1994

[51] Int. Cl.[6] ..... B65B 9/02; B65B 11/50; B65B 61/26

[52] U.S. Cl. ..... 53/411; 53/460; 53/461; 53/553

[58] Field of Search ..... 53/460, 461, 478, 53/411, 206, 558, 553; 178/37

[56] References Cited

U.S. PATENT DOCUMENTS 4,683,708 8/1987 Linder ..... 53/553 X
4,969,594 11/1990 Ashby ..... 53/460 X
5,029,429 7/1991 Noma et al. ..... 53/120
5,031,379 7/1991 Lundblad et al. ..... 53/553 X
5,113,639 5/1992 Bryson ..... 53/461 X
5,355,655 10/1994 Lundblad ..... 53/553 X

*Primary Examiner*—James F. Coan
*Attorney, Agent, or Firm*—Christie, Parker & Hale, LLP

[57] ABSTRACT

A facsimile packaging device and associated method wherein the pages of the facsimile transmission are packaged between a first and second sheet of packaging material which are affixed about their peripheries so as to form a package containing the transmission. The first sheet and second sheet of packaging material are delivered from a single stack of packaging material sheets. The first sheet of packaging material, the pages of the facsimile transmission and the second sheet of packaging material are sequentially delivered to a receiving tray, whereupon the second sheet is affixed to the first sheet to form the package.

20 Claims, 12 Drawing Sheets

FACSIMILE PACKAGING DEVICE AND METHOD

FIELD OF THE INVENTION

The invention pertains to devices and methods for packaging printed material. More particularly, the invention pertains to a device and method for packaging the printed output of a facsimile machine.

BACKGROUND OF THE INVENTION

A variety of devices have been proposed for packaging the output of facsimile machines. In one group of devices, the output of the facsimile machine is folded inside an envelope. One such device is shown in U.S. Pat. No. 5,029,429 by Noma, et al. This reference discloses a facsimile packaging device wherein the pages of the facsimile transmission are folded within a paper envelope which is sealed by a pressure-sensitive adhesive. The envelope paper is pleated and bears tractor holes for tractor feeding the envelope paper to a receiving tray. Individual sheets are cut from the envelope paper supply by a buster knife. The envelope has a transparent window through which an address may be read.

It is advantageous that a system be provided wherein the facsimile transmission need not be folded so that the smoothness of the paper is maintained and the quantity limits associated with the folding are not faced. It is additionally advantageous that a system be provided which permits an envelope to be used that has a window through which most or an entire cover page of the facsimile transmission may be viewed. It is further desirable that a system be provided which permits a convenient transition between packaging and non-packaging modes and wherein the latter does not overly involve the packaging device hardware.

SUMMARY OF THE INVENTION

There is accordingly provided in practice of a preferred embodiment of the invention a facsimile packaging device and associated method wherein the pages of the facsimile transmission are packaged between first and second sheets of packaging material which are affixed about their periphery so as to form a package containing the transmission. A first sheet of packaging material is delivered to a receiving tray within the device whereupon the pages of the facsimile transmission are seriatim delivered to the receiving tray so as to form a stack at the top of the first sheet of packaging material. The second sheet of packaging material is then delivered to the tray so as to lie atop the stack whereupon the second sheet is affixed to the first to form the package.

BRIEF DESCRIPTIONS OF THE DRAWINGS

FIG. 3 is a simplified side cut-away view of a facsimile packaging device showing flow paths there-through;

Figure 1:
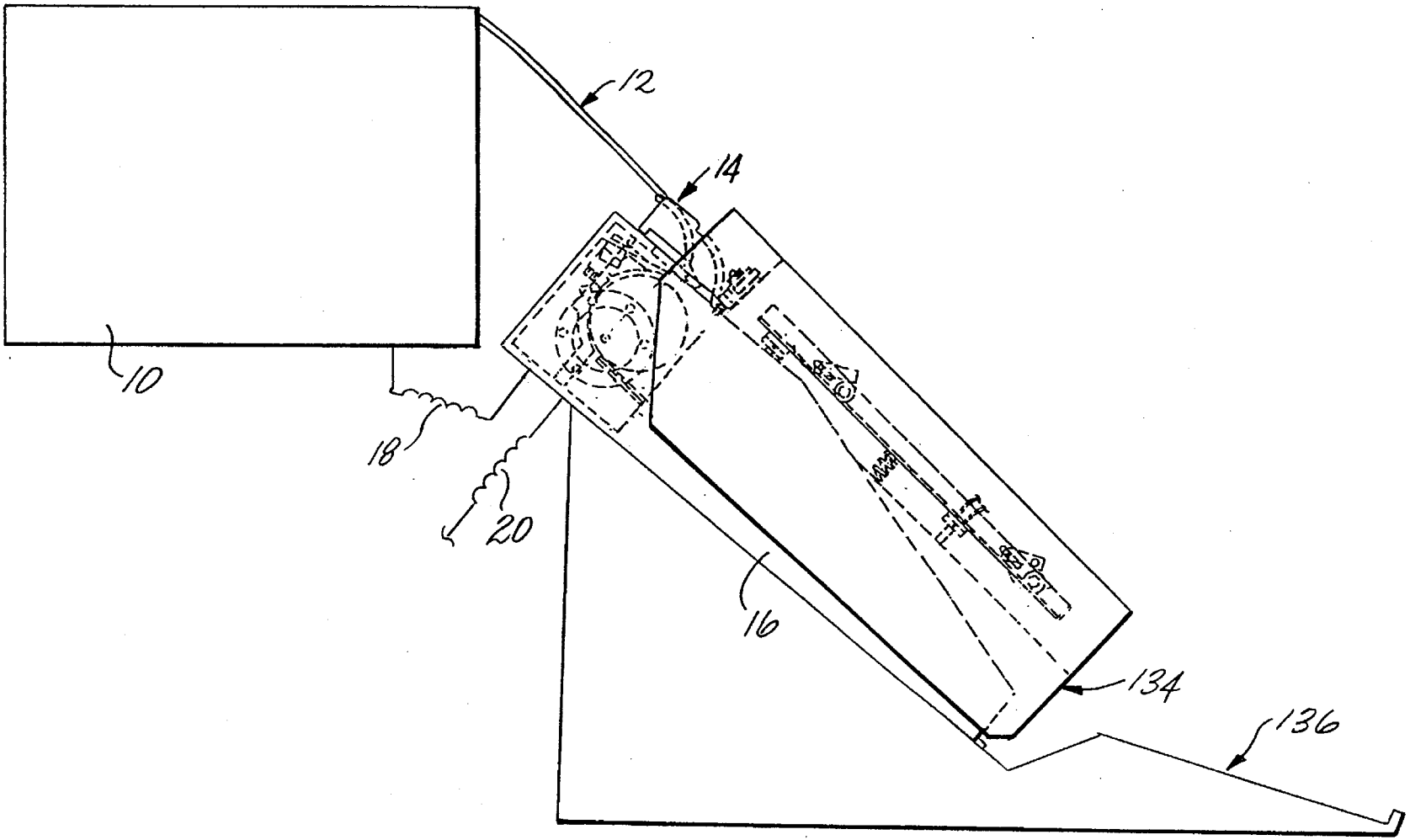
FIG. 1 is a semi-schematic side view of a facsimile receiver and facsimile packaging device.
Figure 7B:
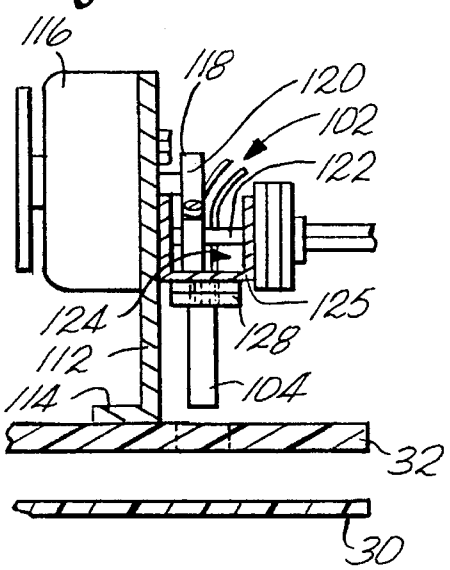
Figure 7A:
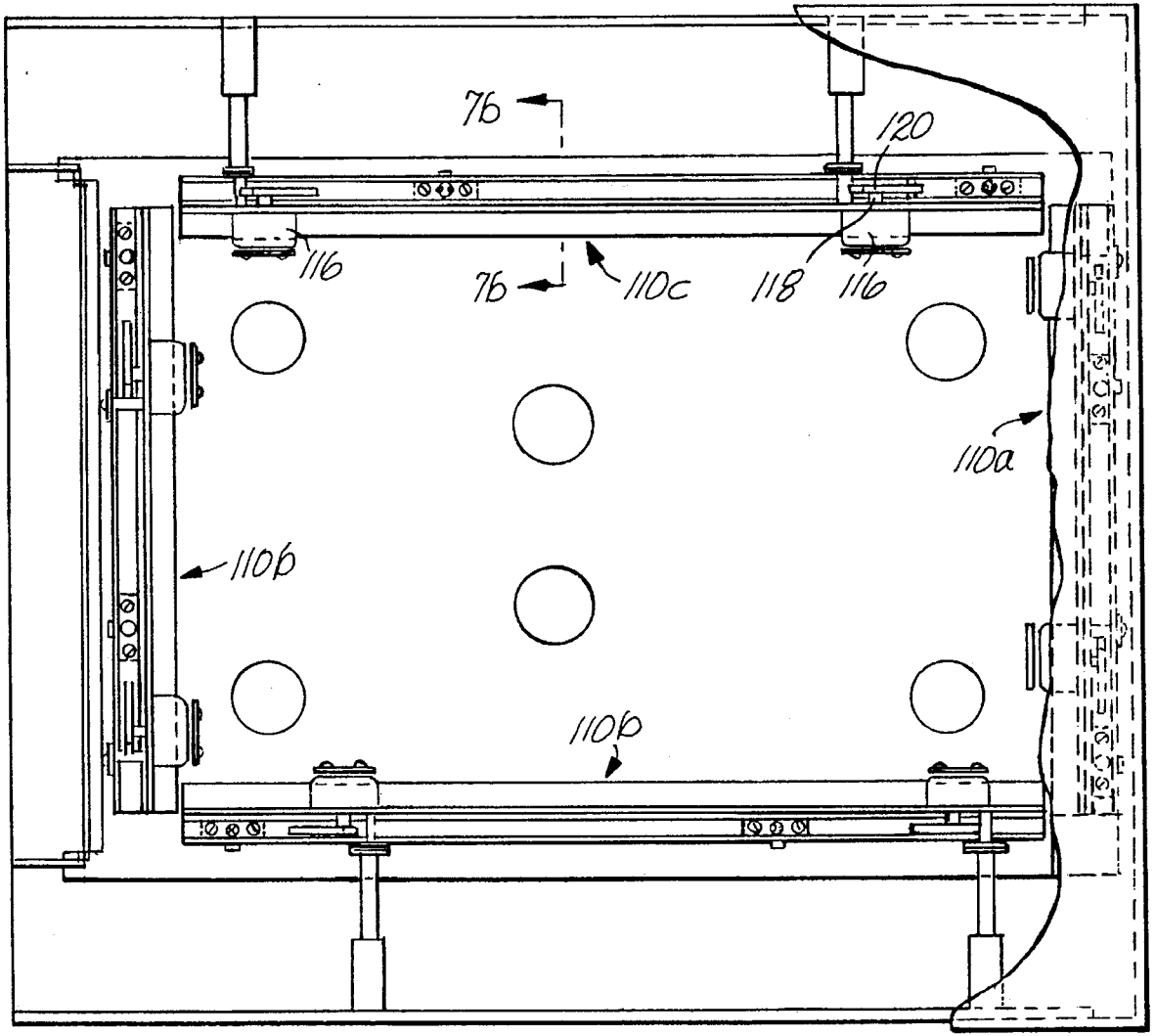
Figure 8A:
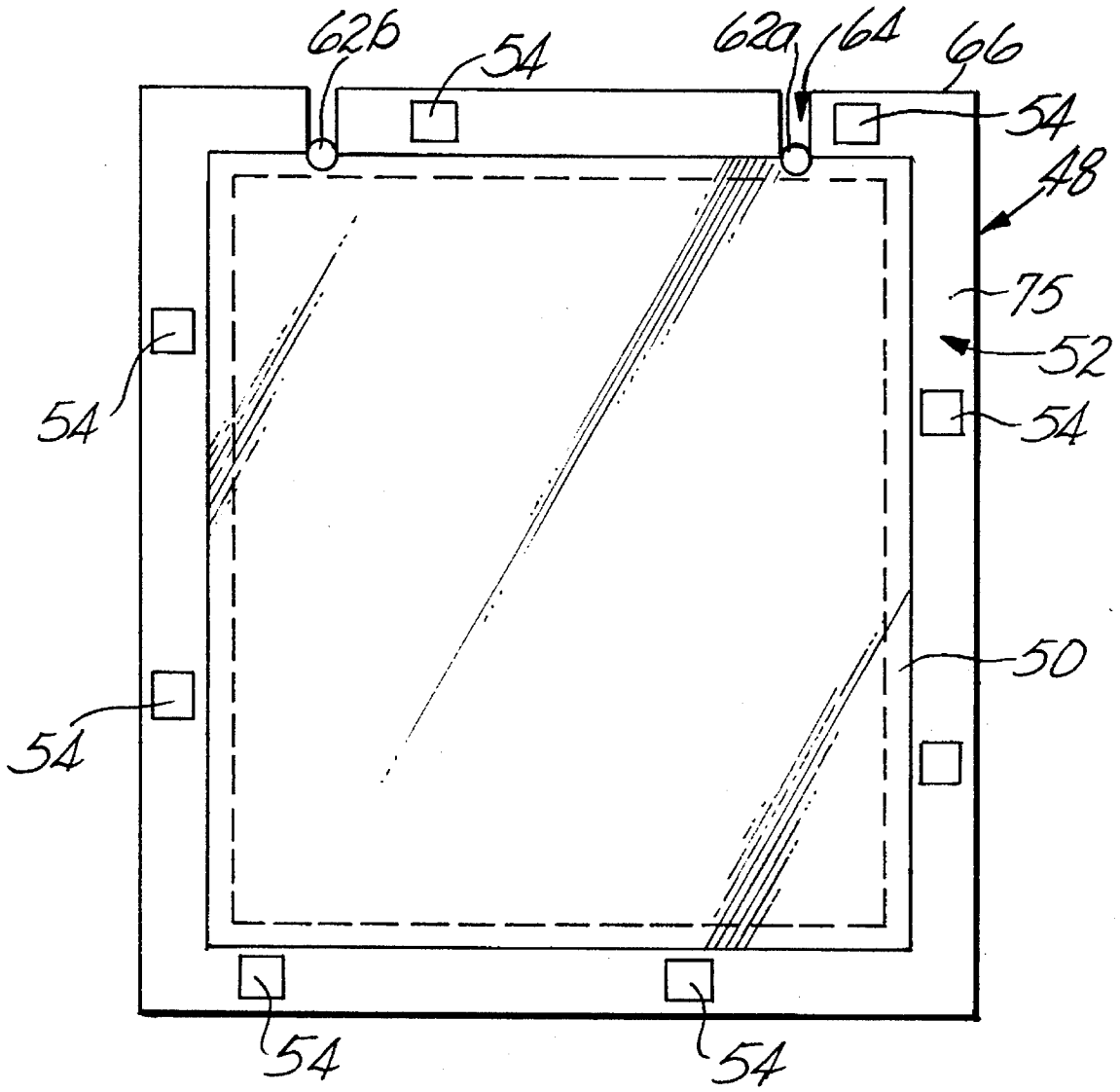
Figure 8B:
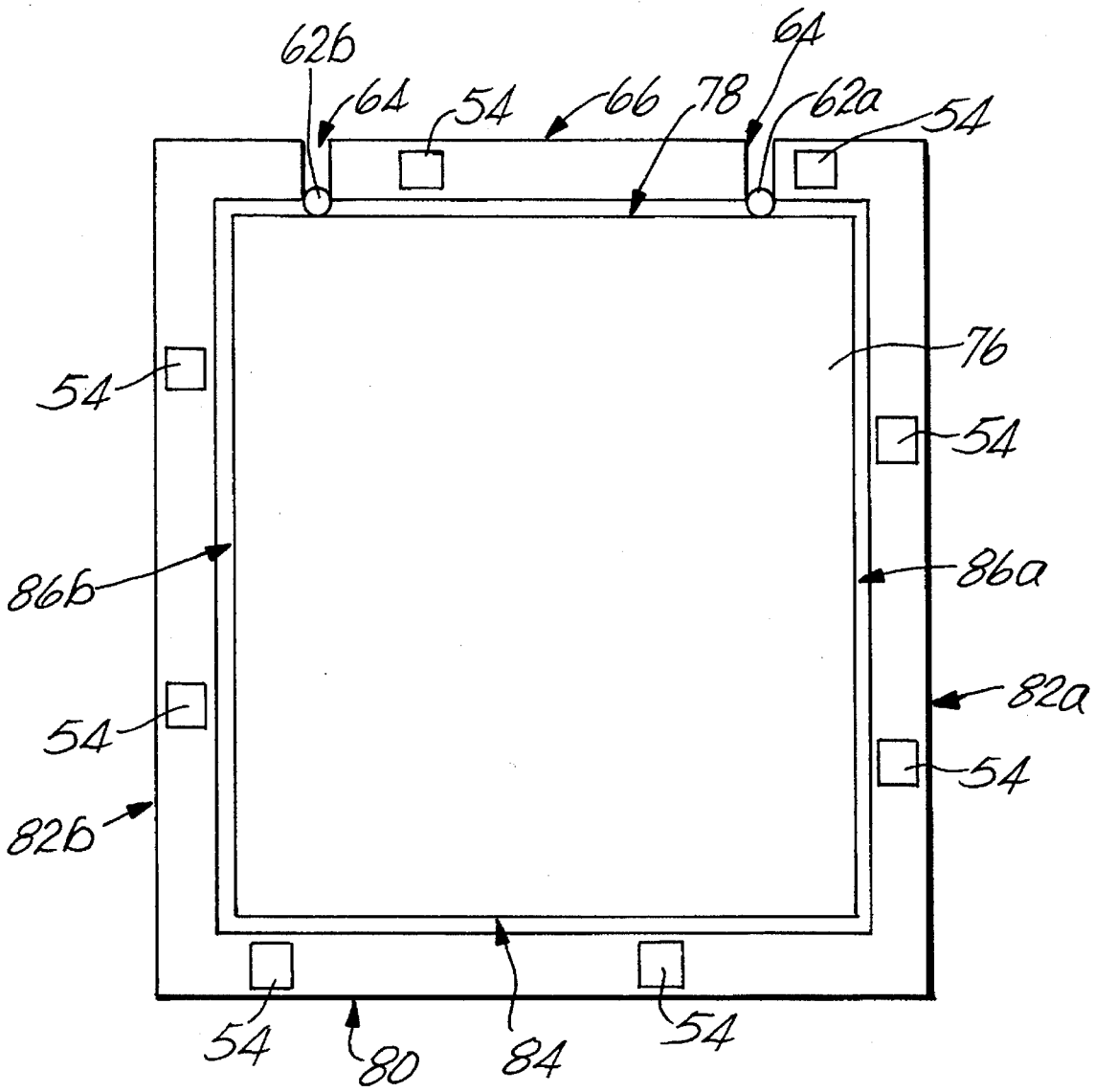
Figure 8C:
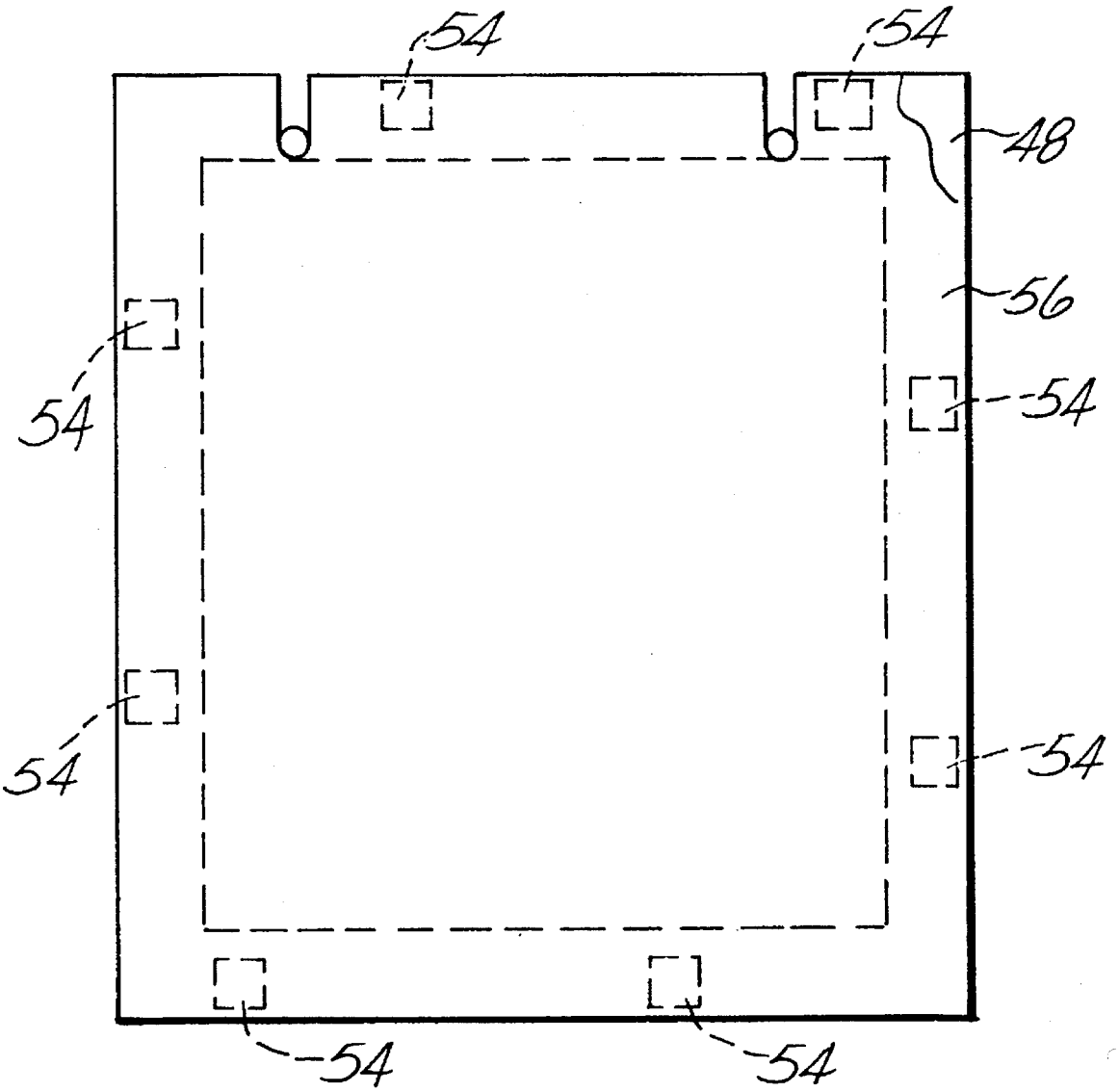
Figure 8D:
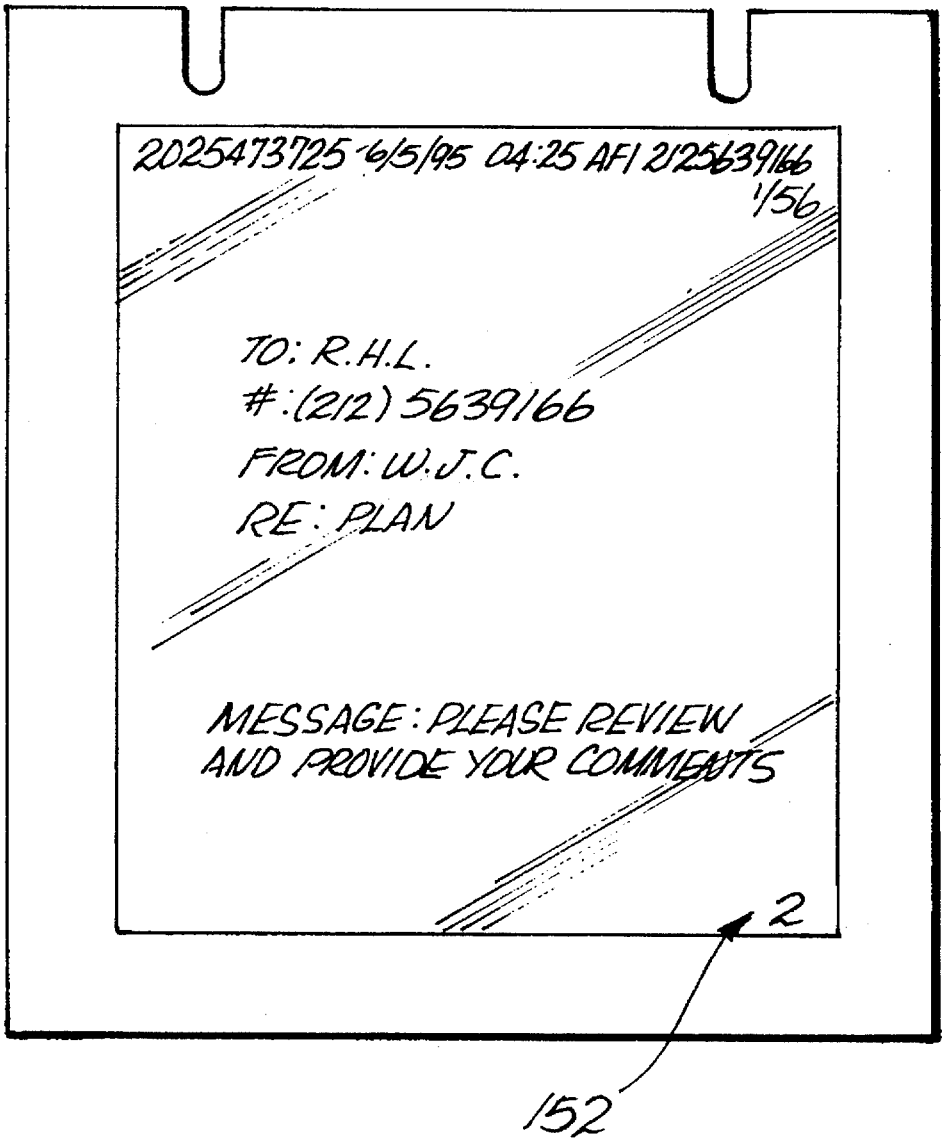
Figure 9A:
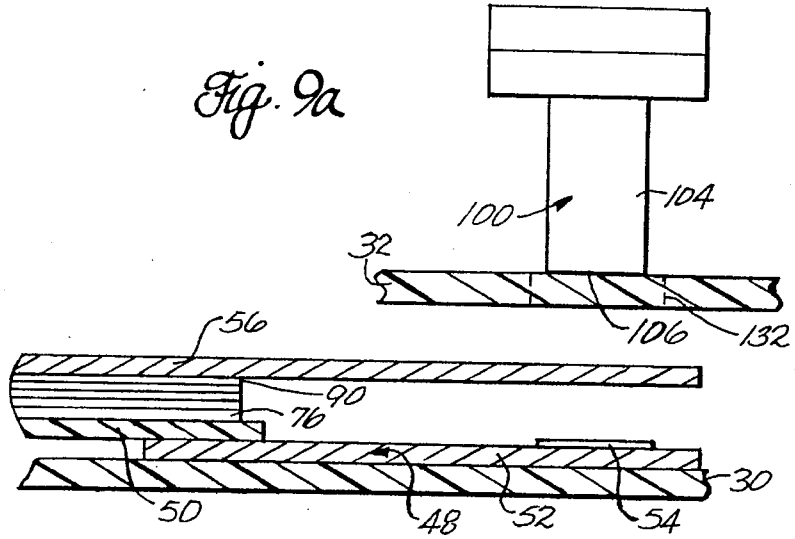
Figure 9B:
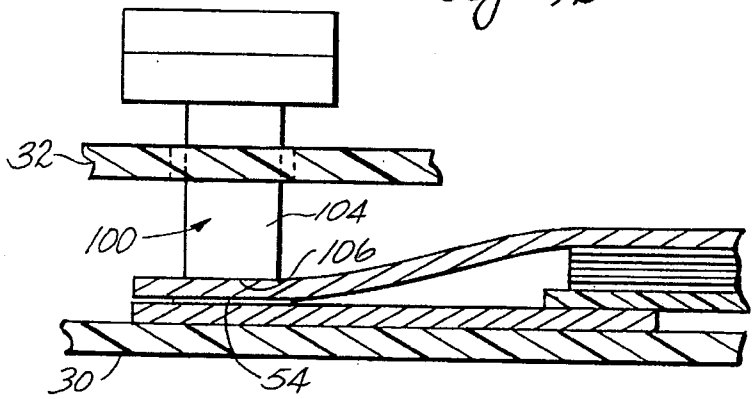
Figure 10:
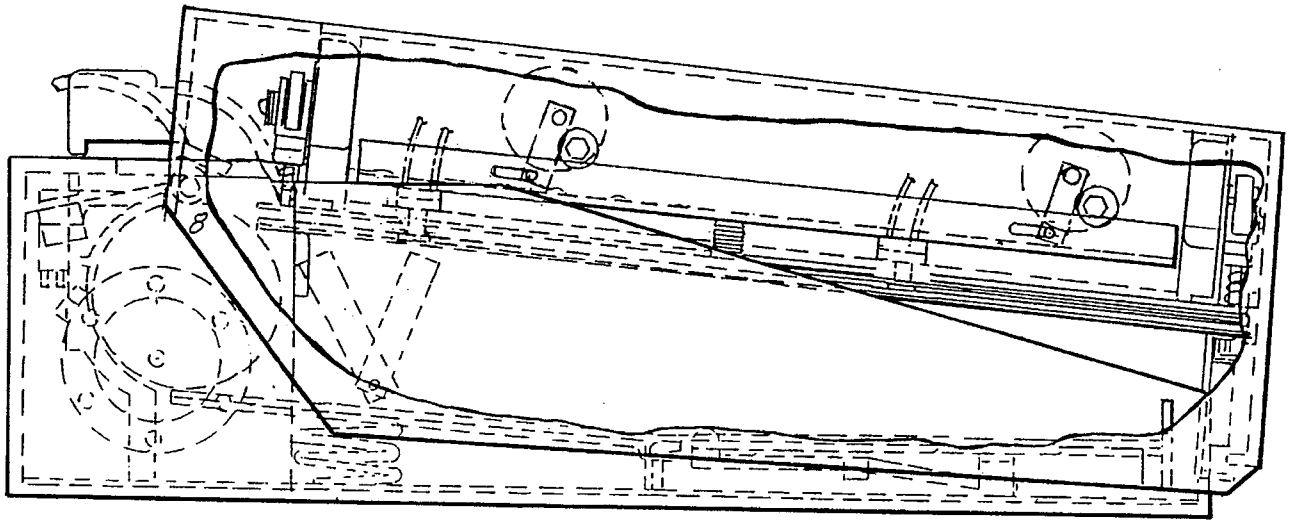
Figure 11:
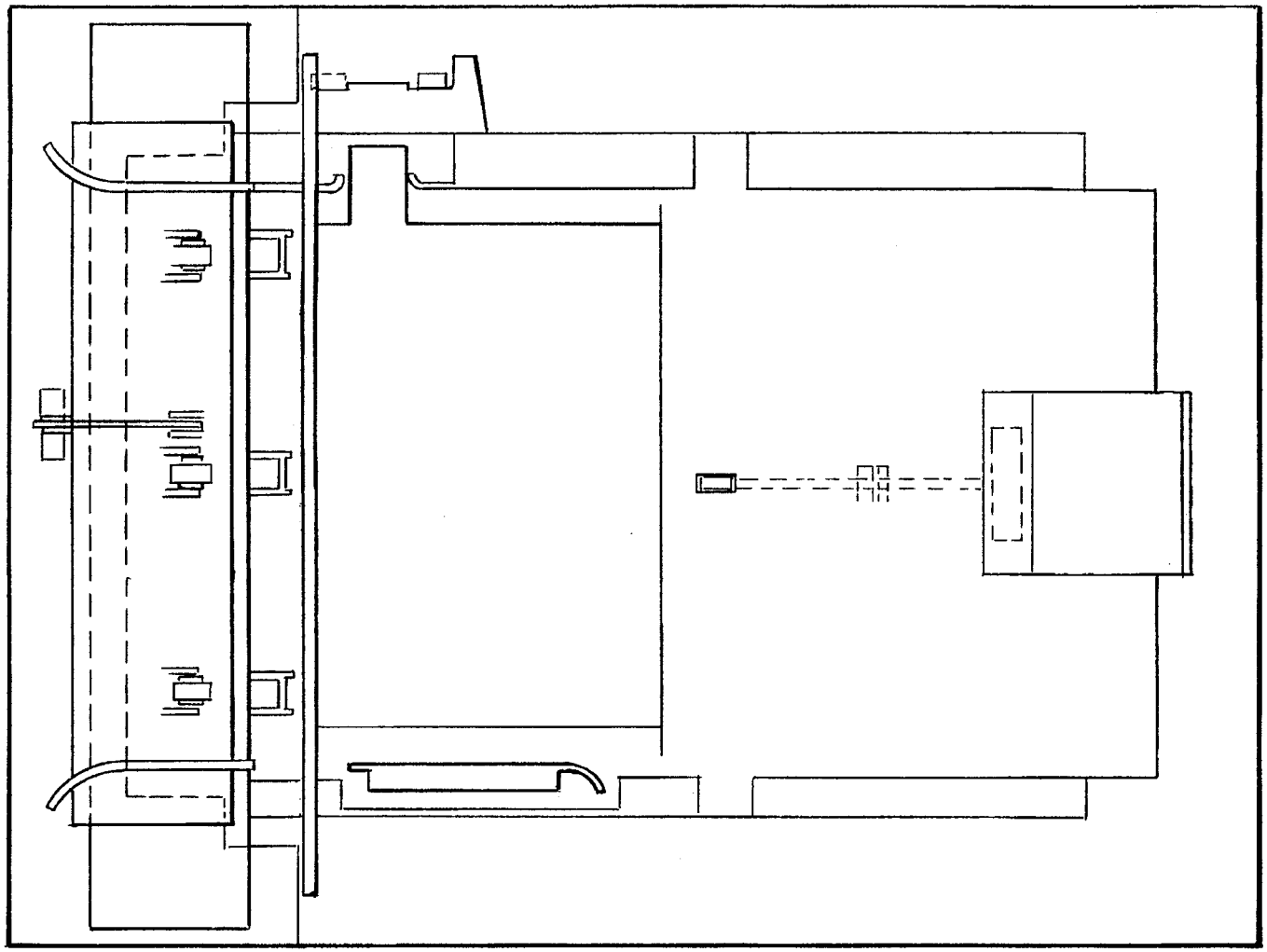

FIG. 7*a* is a partial cut-away view of the facsimile packaging device of FIG. 1 showing features of a receiving area portion the device;

FIG. 7*b* is a partial cross-section of an elevator of the facsimile packaging device of FIG. 3*a*;

FIG. 8*a* is a top view of a first packaging sheet in a receiving tray of a facsimile packaging device;

FIG. 8*b* is a top view of a first transmission page atop a first packaging sheet in a receiving tray of a facsimile packaging device;

FIG. 8*c* is a top view of a package formed by first and second packaging sheets and containing a facsimile transmission in a receiving tray of a facsimile packaging device;

FIG. 8*d* is a front view of a facsimile package with a cover page of a facsimile transmission visible through a window of the package;

FIG. 9*a* is a partial cross-sectional view of a facsimile transmission in packaging sheets with a heating element of a facsimile packaging device shown in a retracted position;

FIG. 9*b* is a partial cross-sectional view of a facsimile transmission in packaging sheets with a heating element of a facsimile packaging device shown in an extended position;

FIG. 10 is a side cut-away view of a facsimile packaging device having heating elements in a lowered orientation; and FIG. 11 is a partial cut-away view of the facsimile packaging device of FIG. 1 showing features of a base portion of the device.

DETAILED DESCRIPTION

As shown in FIG. 1, a facsimile machine 10 has a paper outlet 12 which leads to an inlet 14 of a facsimile packaging device 16. The facsimile machine 10 can be of any number of known designs for receiving signals representing images, processing the signals and reprinting the images on pages of paper. An electrical wire or line 18 runs from the facsimile machine to the facsimile packaging device and a second line 20 leads away from the facsimile packaging device. The line 18 is connected to the facsimile machine 10 in lieu of a direct line from a telephone outlet (not shown). As is further shown in the schematic block diagram of FIG. 2, the second line 20 leads to a telephone system 22 from which a line 24 connects to a facsimile transmitter 26 at a remote location. The facsimile transmitter may be a transmitting facsimile machine, computer or the like. As heretofore described and shown in FIG. 2, without the facsimile packaging device 16 between the facsimile machine 10 and telephone system 22 there would merely be a conventional arrangement for transmitting a facsimile from one location to another.

Although it is possible to make the facsimile packaging device a mere spectator or passive participant in the communication between the facsimile transmitter 26 and facsimile machine 10, in the preferred embodiment the device is an active participant. Thus, electronically, as far as the facsimile transmitter 26 is concerned, the facsimile packaging device 16 acts as a facsimile receiver, exchanging the necessary signals with the facsimile transmitter. Similarly, as far as the facsimile machine 10 is concerned, the facsimile packaging device appears to be the facsimile transmitter and telephone system, exchanging the necessary signals with the facsimile machine.

A facsimile transmission comprises data sent by the facsimile transmitter 26 to the facsimile machine 10 and printed therefrom as a plurality of pages. The pages are, seriatim, ejected from the paper outlet 12 of the facsimile machine 10 and received through the inlet 14 of the facsimile packaging device. It is presently assumed that, as with the most common types of facsimile machines, the pages are ejected face down, so that when allowed to stack, the front or printed side of each page lies atop the back side of the previous page with the front of the first page being exposed at the bottom of the stack.

Figure 3:
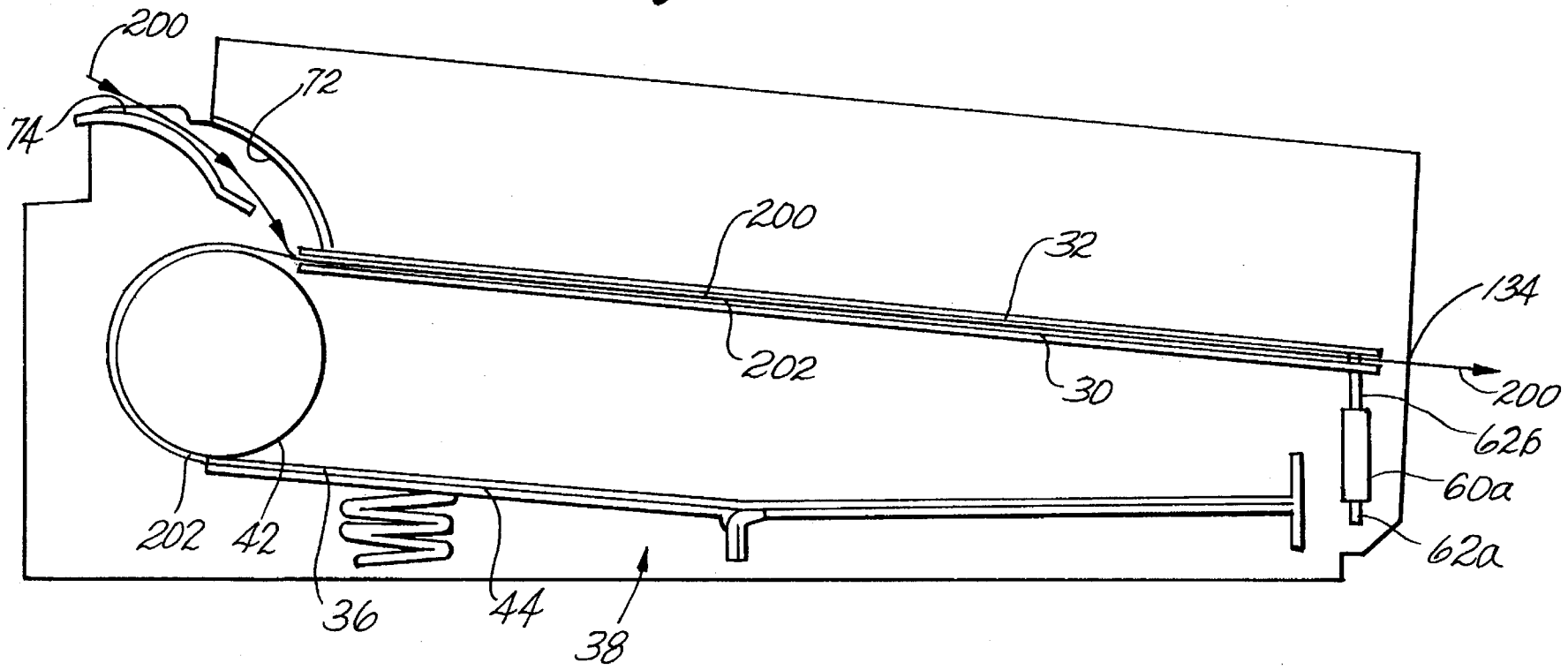

As is shown in FIG. 3, the individual pages of the facsimile transmission proceed along a flow path 200 through the facsimile packaging device. The flow path proceeds through a receiving tray defined by a lower plate 30 which lies below a parallel spaced-apart upper plate 32. Prior to the delivery of the first page of the transmission, however, a first sheet of packaging material must be delivered to the receiving tray.

As shown in FIG. 3, a stack 36 of packaging material sheets is held in a packaging feed tray 38 below the receiving tray. A packaging feed mechanism including a feed roll 42 and controllable spring-loaded forward portion 44 of the feed tray deliver the sheets of packaging material along a flow path 202 which, through the receiving tray, is coincident with the flow path 200 of the facsimile pages. The-construction of the packaging feed mechanism may be that of any suitable conventional paper feed mechanism as are used in photocopiers, computer printers and plotters and even plain paper facsimile machines themselves. A suitable feed mechanism is used in the DESKJET series of ink jet printers manufactured by Hewlett Packard.

Figure 4:
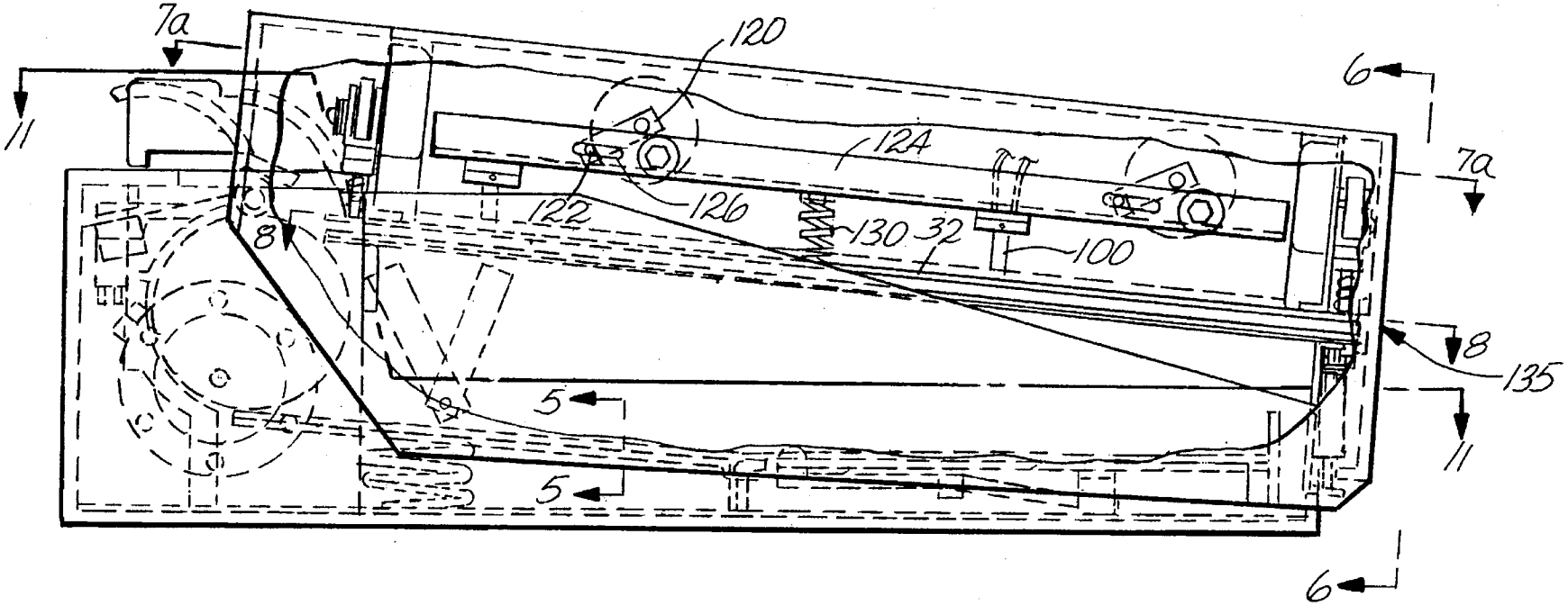
FIG. 4 is a side cut-away view of the facsimile packaging device with hidden features shown in broken lines.
Figure 5:
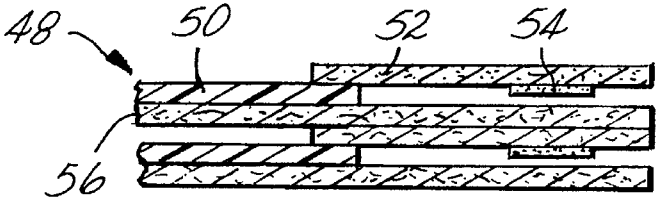
FIG. 5 is a partial cross-sectional view of a stack of facsimile packaging sheets.

The facsimile packaging device is shown in greater detail in FIG. 4 and a partial cross section of the packaging sheet stack is shown in FIG. 5. The stack 36 is formed of stacked pairs of packaging sheets. Within each pair, a first sheet 48 has a central transparent plastic window 50 which, around its periphery, is adhered to a paper border portion 52 forming the periphery of the sheet (also shown in FIG. 8*a*). The border portion bears a plurality of discrete adhesive pads 54. A second sheet 56 is formed as a single layer of paper. Optionally, the first or both sheets may be formed of a single translucent or transparent material such as tracing-type paper. With such a first sheet, the cover page may be viewed directly through the sheet.

Figure 2:
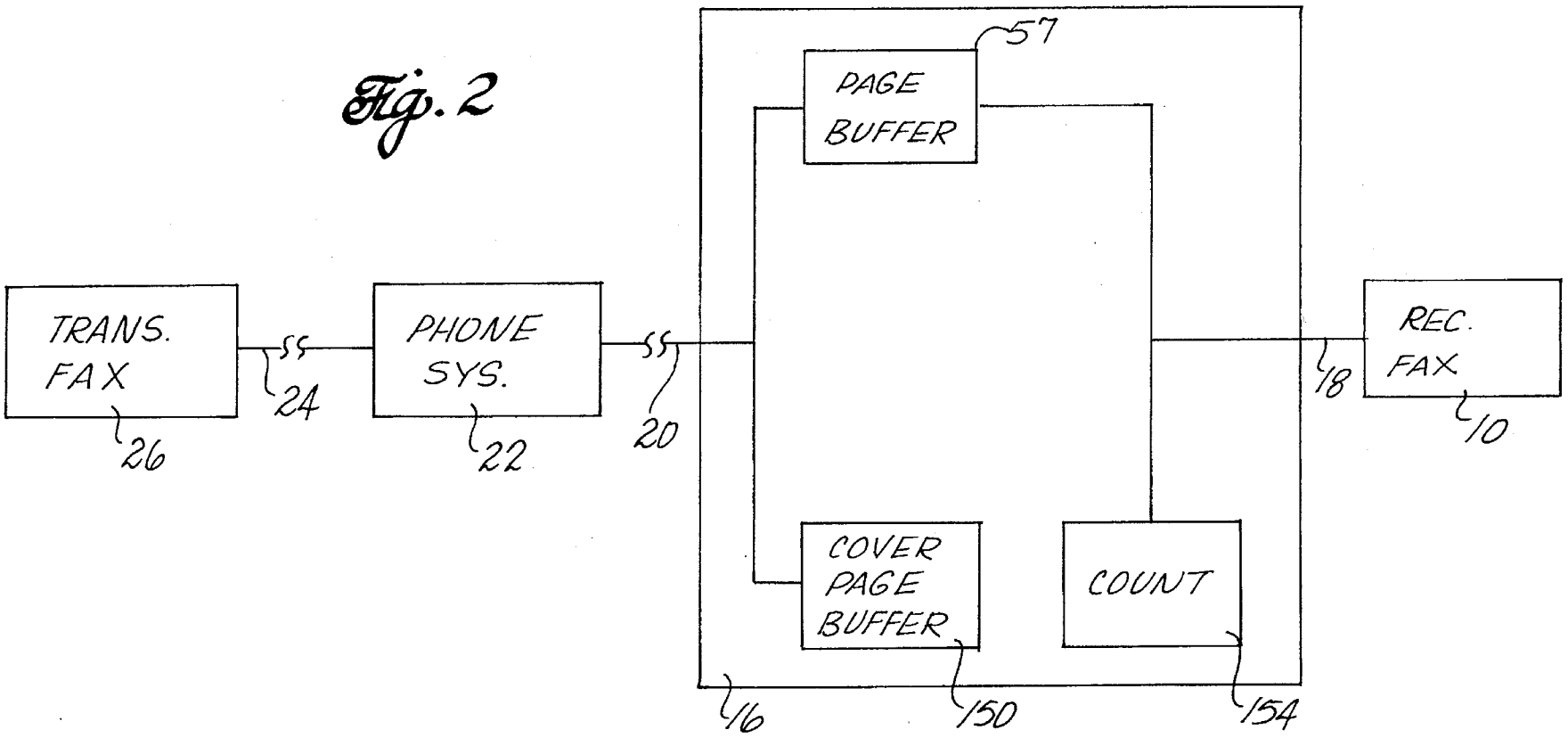
FIG. 2 is a schematic block diagram of a facsimile system including a facsimile packaging device.
Figure 6:
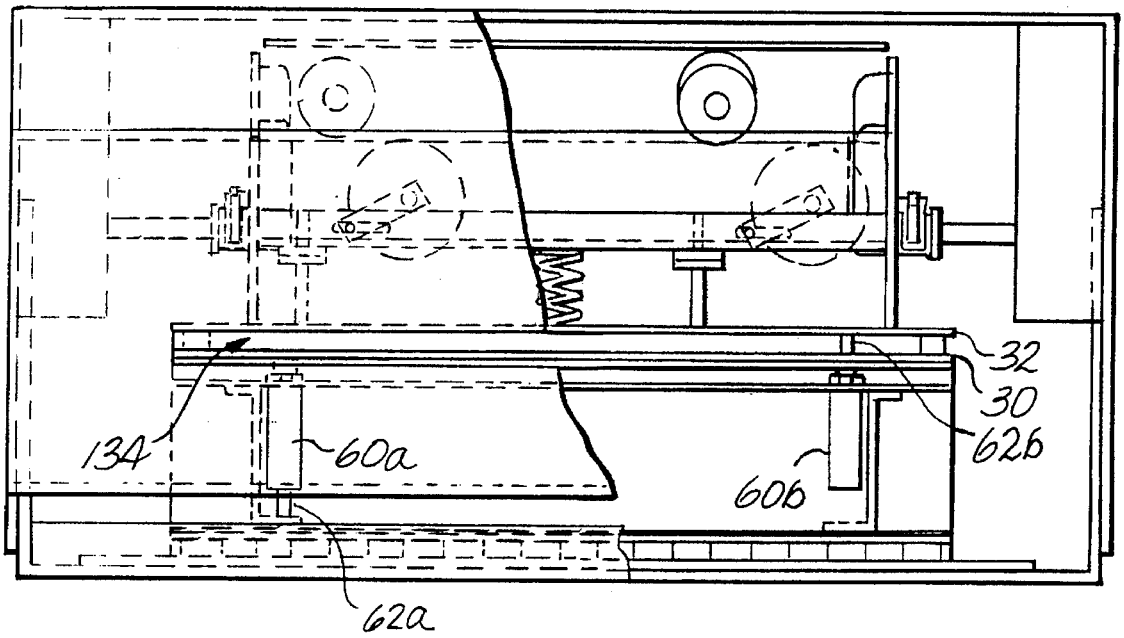
FIG. 6 is a cut-away front end view of the facsimile packaging device of FIG. 4.

When the facsimile packaging device receives an incoming call from the facsimile transmitter, it engages in the necessary exchange of signals with the facsimile transmitter. It does not, however, immediately convey those signals to the facsimile machine but, rather, either delays the transmission from the transmitter, or begins to store that transmission in a page buffer 57 (FIG. 2). If the transmission is to be packaged (which may be automatic or selective), the first sheet 48 is delivered to the receiving tray thus exposing the second sheet. The receiving tray is at an angle so that the movement of the sheet along the flow path 202 is aided by gravity. When the sheet reaches the receiving tray, its forward (downstream) motion is interrupted by a stop system comprising solenoids 60*a* and 60*b* (FIG. 6). A sensor (not shown) may be provided to confirm the arrival of the packaging sheet in the receiving tray.

As is further shown in FIG. 6, the solenoids have pistons 62*a* and 62*b*, respectively. Each piston is moveable between a retracted position (shown for piston 62*a*) and an extended position (shown for piston 62*b*). It is in the extended position that the pistons extend between the lower and upper plates 30 and 32 for blocking the combined flow path 200 & 202 (FIG. 3). The solenoids are actuated by the selective application of a voltage or power. In the preferred embodiment, when no power is applied the solenoids are in the retracted position. When power is applied, the pistons extend until they contact the lower surface of the upper plate 32.

With the pistons in their extended positions, as the first sheet 48 completely enters the receiving tray, the movement of the sheet introduces the pistons to recesses or slots 64 formed in the leading edge 66 of the first sheet 48 (FIG. 8*a*).

After the first sheet 48 has thus been delivered to the receiving tray, the packaging device is ready to receive the first page of the facsimile transmission. At this point, the facsimile packaging device either signals the facsimile transmitter to begin a transmission which is relayed directly to the facsimile transmitter or initiates transmission to the facsimile machine from the page buffer 57 (FIG. 2). As hereinabove described, the first facsimile page is delivered to the receiving tray from the facsimile machine along the flow path 200. The page is directed into the packaging device by an inlet plenum having a concave upper surface 72 and a convex lower surface 74 (FIG. 3). In the exemplary embodiment, the upper and lower surfaces 72 & 74 are formed by inner and outer surfaces of first and second tubular segments extending transverse to the flow path 200. The inlet plenum directs the first page toward the receiving tray where it lies atop the first sheet 48 of the packaging material so that the lower surface of the first page lies in contact with the upper surface of the first sheet. As is shown in FIG. 8*b*, movement of the page along the flow path is impeded when the leading edge 78 of the first page 76 comes into contact with the pistons 62*a* & 62*b*. Because the pistons are accommodated by the slots 64 of the first sheet of packaging material, the leading edge 66 of the first sheet of packaging material extends beyond the leading edge 78 of the first page of the facsimile transmission.

The length and width of the sheets of packaging material are selected so that the trailing edge 80 and side edges 82*a* and 82*b* of each sheet extend beyond the trailing and side edges 84 and 86*a* and 86*b* of the pages, respectively. In an exemplary embodiment wherein the pages are 11 inches long by 8.5 inches wide, the packaging sheets are 12.0 inches long by 9.5 inches wide.

Subsequent pages of the transmission proceed along the flow path until, as with the first page, their leading edges come into contact with the pistons. The subsequent pages form a face-down stack atop the first page.

After the last page of the transmission has been ejected from the facsimile machine and comes to rest atop the printed stack, the second packaging sheet 56 is delivered to the receiving tray atop the last page of the facsimile transmission (FIG. 8*c*) in like manner as was the first packaging sheet.

The second sheet is thus in position to be affixed to the first sheet to form a package containing the pages of the facsimile transmission. As seen in FIGS. 8*a*–8*c*, the first sheet 48 bears, on its upper surface 75 of the border portion 52, eight discrete patches 54 of thermally activated adhesive material. In the preferred embodiment, the patches are formed of 3/16 inch square sheets of film mounting tissue sold by Eastman Kodak Co. of Rochester, N.Y. 14650, under the trademark Kodak Dry Mounting Tissue. The patches 92 are positioned in pairs along the periphery of the sheet with a pair adjacent to each of the leading edge 70, trailing edge 80, and side edges 82*a* and 82*b*. In the illustrated embodiment, the patches are recessed slightly from the edges and are themselves adhered to the upper surface of the first sheet by an adhesive which is suitably a glue such as ELMER'S brand glue by Borden, Inc. of Columbus, Ohio 42315.

When the sheets are positioned as shown in FIG. 8*c*, each adhesive patch 54 is aligned with and beneath a heating element 100 (FIGS. 4, 7*a*, 7*b*, 9*a* & 9*b*) of the facsimile packaging device. The heating elements operate by electrical resistance, each having a pair of leads 102 (FIG. 7*b*) and a copper head or barrel portion 104 approximately 3 mm in diameter. An exemplary heating element may be modified from the heating element of a conventional soldering iron, such as those made by Weller of Easton, Pa., however, one of ordinary skill in the art would design a heating element appropriate for the particular construction of packaging device which is chosen.

Each pair of heating elements is mounted on an elevator 110 with forward, rear, left and right elevators 110*a*, 110*b*, 110*c* and 110*d*, respectively shown in FIG. 7*a*. As shown in FIG. 7*b*, each elevator 110 comprises a support formed of an "L"-sectioned bracket comprising a vertical web 112 and a horizontal foot 114. The foot rests on the top of the upper plate 32 and is secured thereto. Two rotary solenoids 116 are mounted on the inboard face of the web with their respective shafts 118 extending therethrough. Arms 120 are affixed about the distal ends of the shafts 118. The arms extend between the shafts 118 and axles 122 which span a "U"-sectioned channel member 124. Each axle extends through its associated arm with the ends of that axle riding in horizontal slots 126 (FIG. 4) in the two vertical side portions of the channel member 124. The heating elements are mounted to the channel members so that the barrels 104 depend from the base 125 of the channel 124, specifically, the proximal end of each barrel 104 is mounted in a corresponding insulator 128. The leads 102 extend up through an aperture in the base 125. The solenoids and heating elements are connected to a power supply and control system (not shown) by wiring (not shown) for selectively applying power to drive the solenoids and heat the heating elements. As shown in FIG. 4, each channel member 124 is supported and biased into an up (raised) position by a compression coil spring 130 located centrally below the channel and extending downward to the upper plate 32.

To affix the first and second sheets to each other, an electrical power is applied across the leads of each heating element causing the element to heat. A power is then applied to the rotary solenoids causing their shafts to rotate (for example, the shafts of the solenoids of FIG. 1 rotate counterclockwise) so that the arms 120 assume the orientation shown in FIG. 10 moving the axles 122 along slots 126 and thereby lowering the channel members and compressing the springs 130.

The raised and lowered positions of the heating elements are more clearly shown in FIGS. 9*a* and 9*b*, respectively. In the raised position of FIG. 9*a*, the barrel 104 is positioned with its lower end or face 106 slightly above the upper surface of the upper plate 32 and aligned with a circular aperture 132 in the upper plate. It is preferable that the face 106 be at least above the level of the bottom surface of the upper plate 32 so as not to interfere with the passage of the packaging sheets. As also shown in FIG. 9*a*, the facsimile package is ready to be sealed. The first sheet 48 lies with its lower surface predominantly contacting the upper surface of the lower plate 30. The stack of pages lies atop the lower sheet with the first page 76 at the bottom of the stack with its lower surface contacting the upper surface of the window 50. The second sheet 56 lies atop the stack with its lower face contacting the upper face of the last sheet 90.

As is shown in FIG. 9*b*, when the heating elements are lowered, they extend through the upper plate 32 with their lower (distal) ends 106 engaging the upper surface of the upper sheet and pressing it toward the lower sheet. The heat from the heating element melts the adhesive 54 thereby securing the upper sheet to the lower sheet. The power applied to the heating elements is turned off and the elements are returned to their raised position by turning off the power applied to the rotary solenoids.

As the transmission is now packaged, the pistons 62*a* and 62*b* of solenoids 60*a* and 60*b*, respectively, are retracted to unblock the flow path. The package is then free to slide under the influence of gravity through an outlet 134 (FIG. 3) at the forward or downstream end of the packaging device to be collected in a collection tray 136 (FIG. 1).

FIG. 8*d* shows an assembled package containing a facsimile transmission. The facsimile cover page is viewable through the window in the first package sheet. None of the other pages are readable without tearing open or otherwise disassembling the package. It can be seen that the adhesive patches which secure the packaging sheets to each other prevent the pages of the facsimile transmission from falling out of the package. Because the cover page is visible, the addressee can easily be determined and the package delivered thereto while preserving the confidentiality of the contents.

Given the dimensions of the packaging sheets and/or the height of the receiving tray, there will necessarily be a limit on the number of pages which may be placed in a single package. Accordingly, for facsimile transmissions greater than the maximum number (e.g., 50 pages), the transmission must be broken up into a plurality of portions each placed within a separate package. In the exemplary situation, the first package of the transmission contains the cover page through the fiftieth page (the cover page being denominated as the first page). The cover page is visible through the window of the first package. For security reasons, it is desirable that the fifty-first page not be visible through a window of the second package of the transmission. One way to achieve this is to have an alternate packaging sheet stack wherein both sheets of each pair of packaging sheets are opaque. In such a system the second and subsequent packages would be formed from this alternate stack. Another alternative is to simply print a surplus page as the first page of the second and subsequent packages. The surplus page could be a blank page or a form page generated from a memory within the facsimile packing device. A preferred embodiment, however, includes printing the surplus page as a substantial duplicate of the cover page of the transmission. This may be achieved by initially electronically storing the cover page in a cover page buffer 150 (FIG. 2) in the circuitry of the facsimile packaging device. The buffer may comprise random access memory (RAM) in which the image of the cover page is written upon the initial transmission and stored for printing as the first page of the second and subsequent packages containing that transmission. As shown in FIG. 8*d*, the reprinted cover page may be printed with a number 152 which indicates the number of the package within the transmission. The number 152 may be generated responsive to a counter 154 in the facsimile packaging device (FIG. 2).

To effect the transition between successive packages in a multi-package transmission, after the facsimile packaging device delivers the signal corresponding to the last page in a given package, it interrupts the transmission. Again, this can be done either by signalling the facsimile transmitter to pause or by accumulating the transmission in the page buffer. After the package is discharged and a new first sheet delivered to the receiving tray, the facsimile packaging device prints a second cover page or the like and then reinitiates the transmission to the facsimile machine.

If the facsimile packaging device runs out of packaging sheets, it will enter a "null" mode in which the solenoid pistons 62 are retracted so that all pages of the transmission simply proceed through the facsimile packaging device along the flow path 200 without being packaged. Optionally, a control protocol may be provided wherein the transmitting facsimile machine in its initial "handshake" with the facsimile packaging device includes a code which specifies whether the transmission to be sent should or should not be packaged. In the latter case, the facsimile packaging device would enter the null mode even if it had a packaging sheet supply.

There currently exist a number of security protocols for facsimile transmission which may be adapted for use with the present invention. For example, a confidential mailbox protocol featured in certain facsimile machines of Cannon, Inc. provides a system wherein, responsive to commands from the transmission facsimile machine, the receiving facsimile machine records a transmission into memory. The transmission is printable only upon the entry of a password corresponding to the particular mailbox to which the transmission has been sent. This protocol may be adapted so that as an alternative to memory storage, messages sent to selected or all mailboxes are packaged whereas messages not sent to the selected mailboxes are not packaged. This protocol may also be used to print special cover sheets indicating the intended recipient of the transmission.

As heretofore described, the facsimile packaging device has been used in conjunction with a receiving facsimile machine which ejects pages face down. Certain modifications of the system and method are advantageous when used in conjunction with a facsimile printer which ejects pages face up. Specifically, the order of packaging sheets is reversed so that, in a given pair, the sheet with the window is the second sheet. Additionally, the cover sheet is stored in the cover sheet buffer and is then printed as the last sheet in the package (either at the end of the transmission or as the last sheet in each package in a multi-package transmission). In this way, the addressee and other information is visible while the remaining pages are concealed.

Although preferred embodiments of a facsimile packaging device and associated process have been described herein, additional constructions of, uses for and modifications to the device and process are possible. Additional constructions of and materials for the sheet-formed packaging material are available. Thus, although the preferred embodiment features paper packaging sheets, other material such as TYVEK brand polyethylene sheeting from E.I. du Pont de Nemours & Co. may be adopted for use as packaging material. The adhesive used to affix the sheets of packaging material need not be formed in a plurality of discrete pads, but may be substantially continuous around the package perimeters and need not be preformed on the sheets. A variety of thermal and athermal adhesives or affixing techniques may also be used, including welding and pressure-sensitive adhesives. One alternative to the heating heads is to use a beam from a semiconductor laser for heating the adhesive. The beam is directed through a tube which is approximately the size of the heating head and is used to press the sheets together at the adhesive pad as does the heating head. Optionally, a photopolymer may be used as an adhesive and activated by application of long wave ultraviolet radiation.

Packaging devices according to the present invention may, optionally, be used with equipment other than facsimile machines, including computer printers and the like. Furthermore, the facsimile packaging device may be formed as part of the facsimile machine. It is, therefore, understood that, within the scope of the appended claims, the invention may be practiced other than as specifically described.

What is claimed is:

1. A method for packaging a transmission of printed material comprising the steps of:

delivering a first sheet of packaging material to a receiving tray, the delivering the first sheet including introducing a recess in a first edge of the first sheet to a stop member in the tray so that the stop member impedes movement of the first sheet;

delivering a first page of printed material to the receiving tray so that a lower surface of the first page contacts an upper surface of the first sheet of packaging material, the delivering the first page including placing a first edge of the first page into contact with the stop member so that the first edge of the first sheet extends beyond the first edge of the first page;

delivering a second sheet of packaging material to the receiving tray; and affixing the second sheet to the first sheet so as to form a package containing the first page.

2. The method of claim 1 further comprising the step of retracting the stop member to allow the package to leave the tray.

3. The method of claim 1 wherein the step of affixing the second sheet comprises adhering a perimeter portion of the upper surface of the first sheet to a perimeter portion of a lower surface of the second sheet.

4. The method of claim 2 further comprising the step of determining that the transmission is to be packaged.

5. The method of claim 2 further comprising the steps of:

determining that a second transmission is not to be packaged; and delivering pages of printed material of the second transmission to the tray so as to pass by the stop member.

6. A method for packaging a transmission of pages of printed material comprising the steps of:

delivering to a receiving tray a first sheet of packaging material having dimensions longer than the respective dimensions of a largest page of printed material;

delivering the pages of the printed material to the receiving tray so that a lower surface of a first printed page contacts an upper surface of the first sheet of packaging material;

delivering a second sheet of packaging material having dimensions longer than the respective dimensions of the largest page of the printed material; and affixing the second sheet to the first sheet so as to form a package containing the pages of printed material.

7. A method for packaging a transmission of printed material comprising the steps of:

delivering a first sheet of packaging material to a receiving tray by removing the first sheet from a packaging sheet stack so as to expose a second sheet in the packaging sheet stack;

delivering the first page of printed material to the receiving tray so that a lower surface of the first page contacts an upper surface of the first sheet of packaging material;

delivering the second sheet of packaging material to the receiving tray; and affixing the second sheet to the first sheet so as to form a package containing the first page.

8. A method for packaging a transmission of printed material comprising the steps of:

delivering a first sheet of packaging material to a receiving tray;

electronically storing a cover page of the transmission, the cover page preceding a first page of printed material in the transmission;

delivering the first page of printed material to the receiving tray so that a lower surface of the first page contacts an upper surface of the first sheet of packaging material, the delivering the first page including acquiring the first page from a facsimile printer;

printing the cover page as the last page delivered to the tray;

delivering a second sheet of packaging material to the receiving tray; and affixing the second sheet to the first sheet so as to form a package containing the first page.

9. A method for packaging a transmission of printed material comprising the steps of:

delivering a first sheet of packaging material to a receiving tray;

delivering a first page of printed material to the receiving tray in alignment with a transparent window on the first sheet so that text on the first page is visible through the window and wherein the lower surface of the first page contacts an upper surface of the first sheet of packaging material;

delivering a second sheet of packaging material to the receiving tray; and affixing the second sheet to the first sheet so as to form a package containing the first page.

10. An apparatus for packaging a plurality of pages of printed material output from a printing device, the apparatus comprising:

a housing encompassing a page flow path emanating from the printing device and having a receiving area therewithin, at which receiving area the pages are received and collected;

a feed tray for storing a packaging sheet stack, which packaging sheet stack consists of a plurality of individual sheets of packaging material;

a sheet transport mechanism for individually delivering said sheets of packaging material to the receiving area; and securing means for securing a first said sheet of packaging material to a second said sheet of packaging material in the receiving area so as to form a package encompassing said plurality of pages of printed material.

11. The apparatus of claim 10 wherein the step of said sheet transport mechanism is adapted to deliver said first sheet by removing said first sheet from said packaging sheet stack so as to expose said second sheet in the packaging sheet stack.

12. The apparatus of claim 10 wherein the securing means is adapted for adhering a perimeter portion of an upper surface of the first sheet to a perimeter portion of a lower surface of the second sheet.

13. The apparatus of claim 10 further comprises a stop member in said tray for impeding movement of the first sheet and wherein the first sheet comprises a recess in a first edge of the first sheet for accommodating the stop member and wherein the stop member is adapted for contacting a first edge of each page so that the first edge of the first sheet extends beyond the first edges of each page.

14. The apparatus of claim 13 wherein the stop member is retractable for allowing the package to leave the tray.

15. The, apparatus of claim 14 further comprising means for determining that the transmission is to be packaged.

16. The apparatus of claim 10 wherein said printing device is a facsimile printer and wherein the plurality of pages are a facsimile transmission and wherein the apparatus further comprises means for electronically storing a cover page of the transmission and for causing the facsimile printer to print the cover sheet as the last page delivered to the tray.

17. A method for packaging a transmission of printed material comprising the steps of:

delivering a first pre-sized sheet of packaging material to a receiving tray;

delivering a first page of printed material to the receiving tray so that a lower surface of the first page contacts an upper surface of the first pre-sized sheet of packaging material;

delivering a second pre-sized sheet of packaging material to the receiving tray; and affixing the second sheet to the first sheet so as to form a package containing the first page.

18. The method of claim 17 wherein the first sheet of packaging material, the printed material and the second sheet of packaging material are sequentially delivered to the receiving tray.

19. The method of claim 17 wherein the steps of delivering a first pre-sized sheet of packaging material and delivering a second pre-sized sheet of packaging material comprise delivering a first sheet and a second sheet having dimensions longer than the respective dimensions of the first page of printed material.

20. The method of claim 17 wherein the step of delivering the first page comprises acquiring the first page from a facsimile printer and which method further comprises the steps of printing and delivering a cover page to the receiving tray.

* * * * *